US006152099A

United States Patent [19]

Urich

[11] Patent Number: 6,152,099

[45] Date of Patent: Nov. 28, 2000

[54] APPARATUS AND METHOD OF SUPPLYING ADDITIVE TO INTERNAL COMBUSTION ENGINE

[76] Inventor: Carl L. Urich, 7293 S. Sherman St., Littleton, Colo. 80122

[21] Appl. No.: 09/217,006

[22] Filed: Dec. 21, 1998

[51] Int. Cl.[7] ..... F02H 25/00

[52] U.S. Cl. ..... 123/198 A; 123/1 A

[58] Field of Search ..... 123/1 A, 198 A

[56] References Cited

U.S. PATENT DOCUMENTS

| | | | |
|---|---|---|---|
| 1,099,862 | 6/1914 | Schroder | 123/1 A |
| 1,823,796 | 9/1931 | Everwine | 123/198 A |
| 1,925,971 | 9/1933 | Simon | 123/198 A |
| 1,975,619 | 10/1934 | Rector | 123/198 A |
| 2,064,561 | 12/1936 | O'Sullivan | 123/198 A |
| 3,174,472 | 3/1965 | Balogh | 123/198 A |
| 3,816,083 | 6/1974 | Patterson | 123/1 A |
| 3,875,922 | 4/1975 | Kirmiss | 123/198 A |
| 4,306,520 | 12/1981 | Slaton | 123/198 A |
| 4,326,972 | 4/1982 | Chamberlin, III | 252/33.3 |
| 4,338,905 | 7/1982 | Urich | 123/525 |
| 4,369,255 | 1/1983 | Schuettenberg et al. | 44/62 |
| 4,401,439 | 8/1983 | Graiff et al. | 123/1 A |
| 4,515,740 | 5/1985 | Schuettenberg et al. | 264/50 |
| 4,519,342 | 5/1985 | Yoon | 123/1 A |
| 4,639,255 | 1/1987 | Schuettenberg et al. | 44/62 |
| 4,662,327 | 5/1987 | Sprügel et al. | 123/198 A |
| 5,235,936 | 8/1993 | Kracklauer | 123/1 A |
| 5,247,909 | 9/1993 | Simmons | 123/1 A |
| 5,282,445 | 2/1994 | Markou | 123/198 A |
| 5,507,942 | 4/1996 | Davis | 210/94 |
| 5,662,071 | 9/1997 | Robinson | 123/1 A |
| 5,726,132 | 3/1998 | Roby et al. | 508/287 |
| 5,744,681 | 4/1998 | Joly et al. | 585/709 |
| 5,922,923 | 7/1999 | Park et al. | 585/413 |

FOREIGN PATENT DOCUMENTS

| | | | |
|---|---|---|---|
| 541370 | 7/1942 | United Kingdom | 123/198 A |
| WO 9801662 | 1/1998 | WIPO . | |

*Primary Examiner*—Noah P. Kamen
*Attorney, Agent, or Firm*—Fields and Johnson, P.C.

[57] ABSTRACT

An apparatus and method are provided for supplying an additive to enhance the performance of an internal combustion engine. The additive is introduced to the engine through the air intake system, preferably through the PCV line which normally interconnects exhaust gases accumulating from the crankcase to the air intake manifold. In a preferred embodiment, an air regulator provides a controlled flow of air through a container which houses a desired quantity of additive. A resulting air/additive mixture is produced which is introduced through the PCV line into the air intake system of the engine. The additives disclosed are paraffin and mothballs. The apparatus is mounted externally to the engine.

17 Claims, 3 Drawing Sheets

APPARATUS AND METHOD OF SUPPLYING ADDITIVE TO INTERNAL COMBUSTION ENGINE

TECHNICAL FIELD

This invention relates to internal combustion engines and, more particularly, to an apparatus and method of supplying an additive to an internal combustion engine. Another aspect of the invention relates to the provision of an additive which enhances the fuel efficiency of the internal combustion engine and reduces undesirable emission pollutants generated from the internal combustion engine. Yet another aspect of the invention relates to the provision of an additive which provides lubrication to the internal combustion engine.

BACKGROUND ART

A number of prior art devices and methods exist for enhancing the functioning of an internal combustion engine. One common way in which to improve the functioning of an internal combustion engine is the provision of additives to the fuel or lubricating oil of the engine in order to improve the combustion efficiency of the engine which, in turn, will normally reduce emission pollutants. Lubrication for the internal moving parts of the combustion engine may also be provided by an additive.

One example of a prior art device is U.S. Pat. No. 5,235,936 which discloses a ferrocene injection system. This reference describes a container having an internal reservoir which holds a quantity of solid phase ferrocene. Means is provided for maintaining an elevated reservoir temperature sufficient to produce a vapor of ferrocene. The reservoir is connected to the air inlet system of a combustion engine in such a manner that the ferrocene vapor is metered into the air inlet stream. Ferrocene is known as a fuel additive which improves combustion quality, reduces emission pollutants and generally increases the efficiency of fuel combustion systems.

U.S. Pat. No. 5,247,909 discloses a combustion enhancement system for a combustion engine which reduces undesirable emissions in which a solid combustion enhancing substance is converted into a highly dispersed, gas transportable state at a controlled rate and is subsequently conveyed into the zone of combustion. The solid combustion enhancing substances are preferably Group VIII metals such as platinum which undergo sublimation in order to be converted to the gas transportable state. Electric current is used to heat strips of platinum and a temperature controller means is used to control the rate of sublimation. The combustion enhancing substance is introduced through the air intake system of the combustion engine.

U.S. Pat. No. 5,662,071 discloses an air intake assembly for an internal combustion engine which includes a powdered mixture of potassium chlorate and manganese dioxide within a paper envelope which is attached to the air cleaner of the internal combustion engine in order to provide improved combustion and reduced fuel consumption. The device embodying this invention can be used by mounting it directly to the air intake system so that the incoming air flows over and through the paper envelope containing the powdered mass. A terry cloth-type fabric cover encloses the paper envelope and an adhesive is used to affix the fabric cover to the wall of the air cleaner intake.

The above discussed references are representative of additives introduced to the internal combustion engine through the air intake system.

There are additional prior art references which disclose additives which may be added directly to the fuel tank of an internal combustion engine, or to a fuel return line within the fuel system. Representative examples of devices of this first type include U.S. Pat. No. 4,639,255. This reference discloses a solid form additive which is added directly to the fuel tank for controlling engine deposits. The additive may in the form of pellets or other materials which may simply be poured into the gas line leading to the gas tank. The solid form additives are provided with a material which allows them to float within the gas tank which prevents blockage of connecting fuel lines. One of the components of the solid form additive includes paraffin. An example of the second type is U.S. Pat. No. 4,662,327 which discloses an apparatus for the continual supply of an additive to an internal combustion engine through a fuel return line.

U.S. Pat. No. 4,401,439 pertains to fuel and lubricant compositions for reducing octane requirements in internal combustion engines. This reference discloses the injection of the compositions directly into the intake manifold, adding the compositions to the fuel separately, or adding the compositions to the crankcase lubricating oil. The specific compositions disclosed are urea citrates.

While the foregoing may be suitable for their intended purposes, the invention disclosed herein has certain distinct advantages.

One advantage is that the apparatus of this invention may be easily installed on any internal combustion engine with a minimal amount of effort. Another advantage is that the apparatus is an independent, self-contained unit and may be easily mounted to the internal combustion engine without the need for any substantial engine modification. Another advantage of this invention is that no external heating or cooling means are necessary to achieve optimal performance. Another advantage of this invention is that it provides increased engine performance not only in terms of enhancing the combustion process and reducing pollutants, but also in providing lubrication to the internal moving parts of the engine. Yet another advantage of the invention is that it may be easily disconnected from the engine without the need for special tools or expertise. Another advantage is that the additive used is inexpensive, safe for handling, and may be purchased and handled by a user without the need for special licenses or permits. Yet another advantage is that refill of the additive used can be accomplished with the normal servicing of the engine.

SUMMARY OF THE INVENTION

In accordance with the present invention, an apparatus and method of supplying an additive to an internal combustion engine are provided. In its simplest form, the apparatus includes a container which holds a quantity of additive, and a controlled flow of air flows through the container to make contact with the additive to form a mixture which is added directly to the combustion chamber of the engine through the air intake system. The additive is either paraffin or mothballs. Paraffin or mothballs may be used alone, or in combination with one another within the container. As used herein, the term "mixture", as applied to the additive and flow of air which contacts the additive, is the additive suspended in the flow of air in a vaporized and/or atomized state. The term "paraffin" as used herein refers to those normally solid hydrocarbon mixtures which are used to make candles, wax paper, lubricants, and sealing materials. The term "mothballs" as used herein refers to marble-sized balls made of napthalene, which are commonly stored with clothes to repel moths. The paraffin and mothballs intended to be used as an additive in the apparatus of this invention are simply those materials which are made of the above-described hydrocarbons and naphthalene, and which are commercially available to the general consuming public.

An air control device which may be in the form of a standard air flow regulator or air valve controls a metered amount of air flow into the container which holds the additive. An air filter may be added to the air flow regulator in order to filter incoming air. As the engine runs, heat given off by it will cause the paraffin additive to liquefy. As the air flow passes through the container, a small amount of the paraffin additive is then vaporized and/or atomized, as best understood. If mothballs are used as the additive, the heat generated by the engine and the air flow through the container causes the mothballs to sublimate, as best understood. Then, the air/additive mixture is added directly to the combustion chamber of the engine through the air intake system. In the preferred embodiment, a transfer line connects directly to the positive crankcase ventilation (PCV) line of the engine so that the air/additive mixture may be introduced to the combustion chamber. For those internal combustion engines which may not have a PCV system, the air/additive mixture may be added to the combustion chamber through the air intake system downstream of the air filter of the engine. The air/additive mixture is simultaneously burned along with the air/fuel mixture of the engine during combustion. By adding the air/additive mixture, the quality of combustion is enhanced which results in better fuel economy and reduced emission pollutants. Also, since the paraffin or mothballs come into contct with internal moving parts of the engine, lubrication is also achieved. Furthermore, when the engine is cold, any unburned paraffin introduced previously into the engine by the air/additive mixture will solidify and, therefore, provide additional lubrication during startup.

The air regulator and container are simply mounted externally to the engine within available space. The container may be filled with paraffin, mothballs, or a combination of the two.

If the engine is exposed to elevated temperatures, such as during summer months, an insert or liner may be used within the container to slow the rate by which the additive is consumed.

Acceptable setup procedures resulting in good operation of the installed apparatus is achieved by evaluating the performance of the engine when it is monitored by an emission analyzer, and then adjusting the air regulator so that the measured engine emissions conform to applicable state or federal standards.

As mentioned above, the introduction of the air/additive mixture to the combustion chamber of an internal combustion engine has been shown to greatly improve the combustion efficiency of the engine, reduce emission pollutants, and also provide additional lubrication to the internal moving parts of the engine.

Additional advantages of this invention will become apparent from the description which follows, taken in conjunction with the accompanying drawings.

BEST MODE FOR CARRYING OUT THE INVENTION

Figure 1:
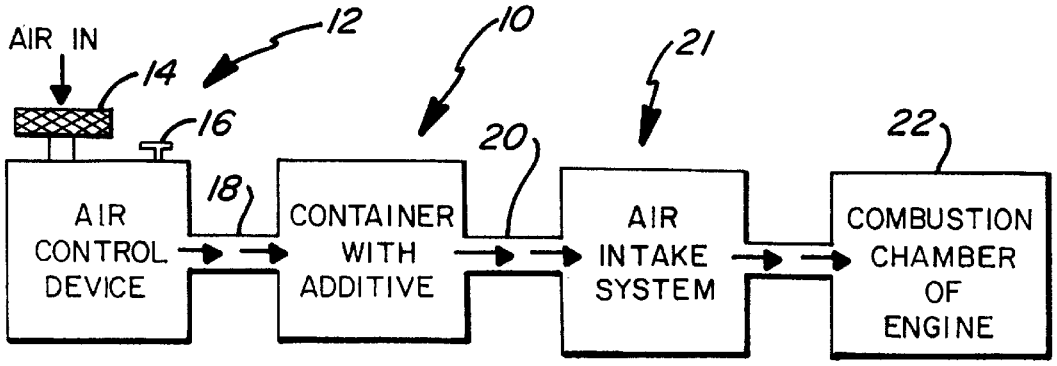
FIG. 1 is a simplified block diagram illustrating the major components of the apparatus of this invention in connection with an internal combustion engine.

As shown in FIG. 1, an additive container 10 has a metered quantity of air flowing therethrough as controlled by air control device or air regulator 12. Air control device 12 may include an air filter 14, and an air control adjustment 16 which meters the quantity of air allowed to flow into container 10. Transfer line 18 connects air control device 12 to additive container 10. The air/additive mixture is transferred to the air intake system 21 of an internal combustion engine by transfer line 20. Air intake system 21 communicates with the combustion chamber 22 of the engine wherein the air/additive mixture is combusted along with the air/fuel mixture of the engine. As is well understood in the art, this air flow occurs because a vacuum is created from within the combustion chamber of the engine.

Figure 5:
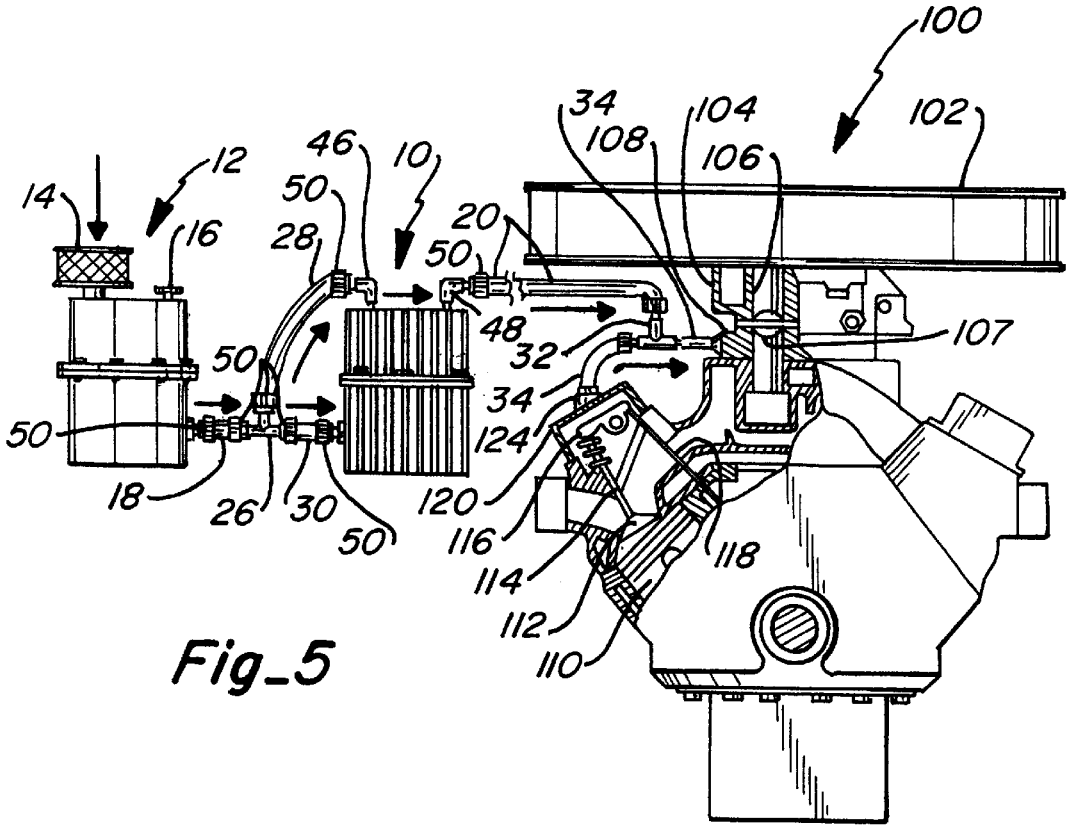
FIG. 5 shows the apparatus of this invention connected to a conventional internal combustion engine of the type having a carburetor, the apparatus of this invention being shown enlarged for purposes of clarity.
Figure 2:
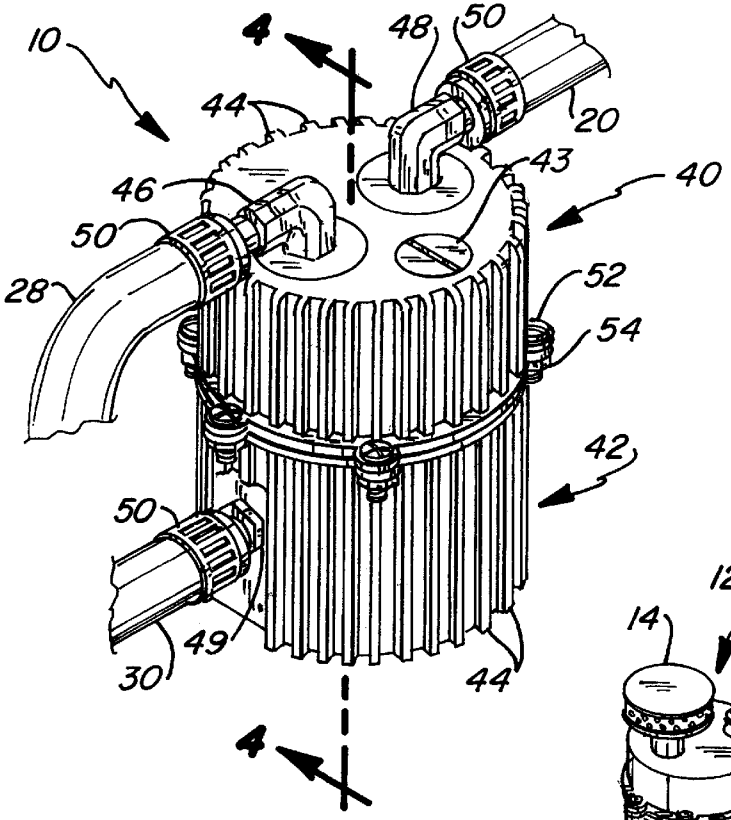
FIG. 2 is a greatly enlarged perspective view of the additive container.

The apparatus of this invention may be mounted externally to the combustion engine by any well-known means such as brackets, or other mounting structures. As shown in FIGS. 2 and 5 in the preferred embodiment, air from the environment enters air regulator 12 through air filter 14. The flow rate of air provided to the additive container 10 may be adjusted as desired by adjuster 16. Air regulator 12 may be any well-known industrial needle valve or other air control device which meters a quantity of air flow therethrough. The air flow through regulator 12 flows through transfer line 18 and into T-connector 26. T-connector 26 provides two points at which air flow may then enter container 10. As shown, transfer lines 28 and 30 provide the air flow into container 10. By providing two points of entry for the air flow into container 10, the surface area of the additive in contact with the air flow may be increased which, in turn, may increase the rate by which the additive is vaporized or atomized. However, it will be understood that it is only necessary to have one point of entry into the container 10. The air/additive mixture exits the device 10 through transfer line 20. T-connector 32 allows connection of transfer line 20 with PCV line 34.

As further shown in FIG. 2, the additive container 10 is shown in more detail. The container may be fabricated from die cast aluminum or some other appropriate metal or plastic which is capable of withstanding the heat generated by the engine. As shown, the container 10 has an upper housing 40, a lower housing 42, and a plurality of heat transfer ribs 44 which extend longitudinally along its length. The upper surface of upper housing 40 may include an access cover 43 which allows viewing into the interior of the container 10, and may also serve as the refill point for the additive. These heat transfer ribs 44 allow the additive contained within the container to more quickly be heated when the engine is operating. The heat transfer ribs, therefore, provide additional surface area by which heat can be transferred to the interior of the container.

During engine startup, the paraffin will be in a solid state, and in order for the air/additive mixture to be formed, the paraffin must be heated to a liquefied state. As best understood, when paraffin is used as the additive, it first liquefies and then is primarily vaporized. It is believed that some atomization occurs; however, the primary interaction between the air flow and the exposed liquefied paraffin is vaporization. Over time, the paraffin is consumed in the process which requires the container to be refilled. For mothballs, as best understood, it is believed that the mothballs undergo sublimation due to the exposure to heat and air flow. Therefore, the mothballs are also slowly consumed over time.

An inlet elbow 46 communicates with the upper surface of the container, as well as an outlet elbow 48 which allows transfer of the air/additive mixture out of the container. Inlet fitting 49 allows another entry point for air to enter the container. A plurality of hose clamps 50 may used to securely connect transfer lines 20, 28 and 30 as shown. A plurality of peripherally spaced conventional nut and bolt combination 52 and 54 may be used to connect the upper and lower housings 40 and 42.

The transfer lines used in the apparatus of this invention may simply be well known reinforced rubber fuel lines which are used in the fuel system of any vehicle. The T-connectors and elbows may be constructed of brass, or other common metals resistant to corrosion.

Figure 3:
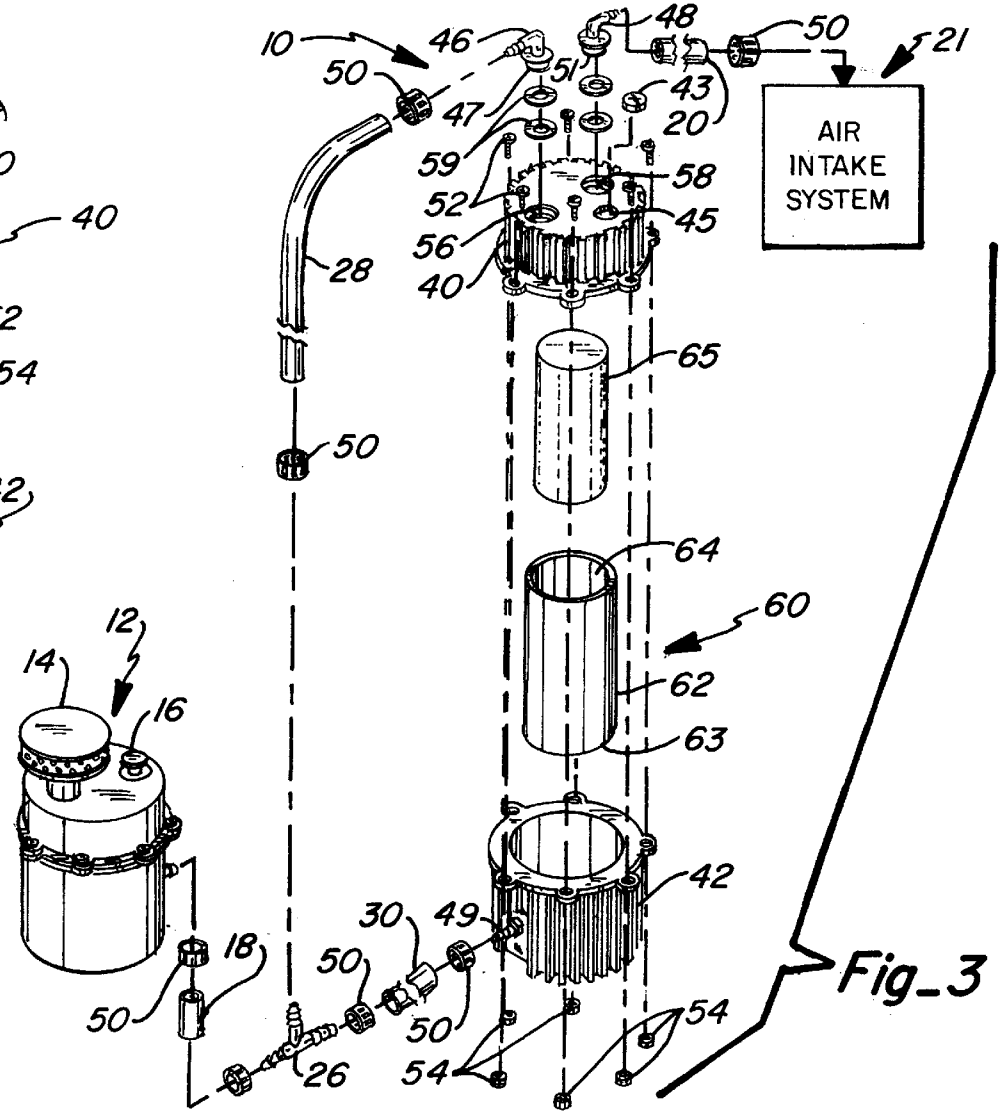
FIG. 3 is an exploded perspective view of the additive container and air regulator.

As seen in FIG. 3, elbows 46 and 48 may be secured to the upper housing 40 by means of threaded ends 47 and 51, which are received in threaded wells 56 and 58, respectively. A series of grommets/seals 59 may be used to ensure airtight connections.

During situations in which the engine is operated in warm temperatures, a liner insert 60 may be inserted within the container to slow the rate by which the additive is vaporized/atomized. The insert 60 may be simply described as having a cylindrical side wall 62, a closed bottom 63, and an upper opening 64. Accordingly, as best seen in FIG. 3, the only portion of the air flow which would contact the additive is at the upper opening 64 of the insert 60. The additive shown in FIGS. 3 and 4 is a block of solid paraffin 65 which may be sized to fit within liner insert 60.

If the block of paraffin 65 is used, then the upper and lower housing 40 and 42 must be separated for refill. However, if mothballs, or smaller sized chunks of paraffin are used, access cover 43 may be removed to allow refill.

Figure 4:
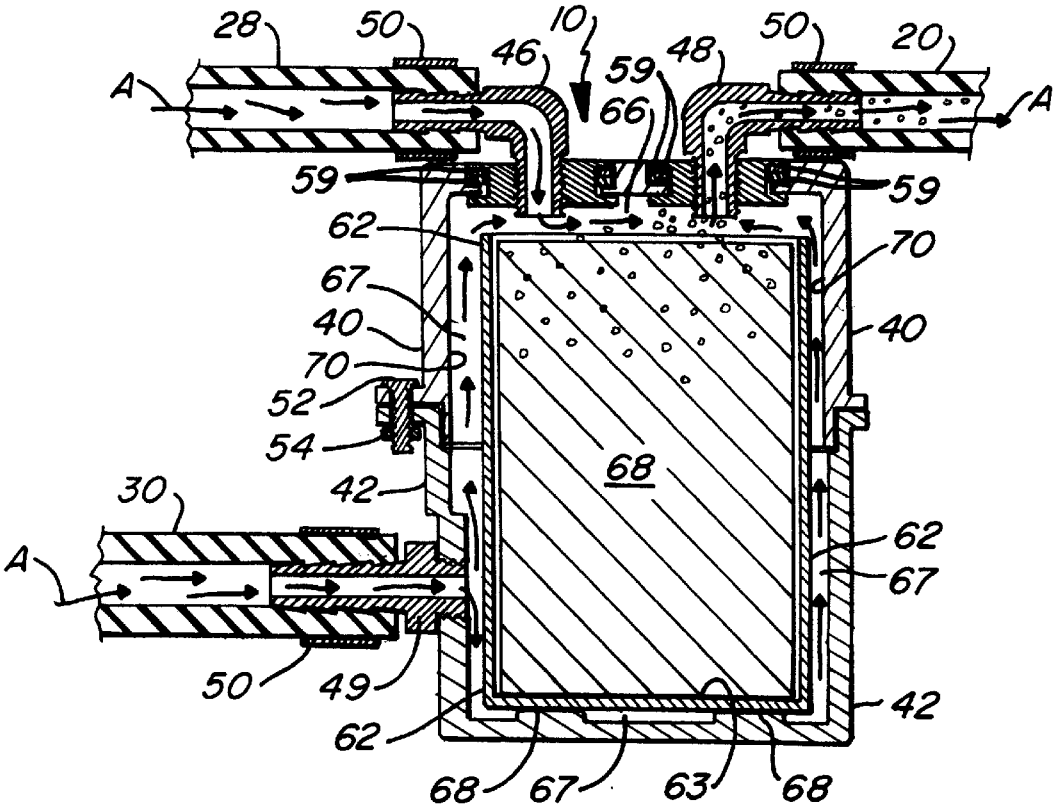
FIG. 4 is a greatly enlarged vertical section, taken along line 4—4 of FIG. 2 illustrating the flow of air through the additive container, and further illustrating the relationship of the additive within the container during operation.

As shown in FIG. 4, an upper gap or open area 66 is maintained within container 10 so that a flow of air indicated by directional arrows A may flow through the interior of the container and in contact with the additive to form the air/additive mixture. Additionally, when liner 60 is used, a gap 67 should be maintained between the exterior surfaces of liner 60 and the interior surface 70 of container 10. This ensures that there is no undesirable back flow of air through transfer line 30 which could otherwise interrupt a steady flow of air into container 10. The interior chamber of container 10 may have a grooved or raised bottom portion 68 which also creates a gap 67 for air flow.

When liner 60 is not used, the air entering the container through transfer line 30, if of a sufficient velocity, results in air bubbling up through the liquefied paraffin additive which causes air to be entrained within the liquefied paraffin additive. This entrainment of the air within the liquefied paraffin additive, as best understood, helps in the vaporization/atomization of the paraffin additive. For mothballs, the air entering the transfer line 30 allows greater contact between the mothballs and the air flow. Particularly for mothballs found near the bottom of the container, the exposure to air flow allows these mothballs to contribute to creation of the air/additive mixture. Since the mothballs do not liquefy like the paraffin, small gaps exist between them which allows air entering the container through line 30 to pass upwardly through the container and to the outlet for transfer to the engine's air intake system.

As well understood by those skilled in the art, a perfect seal between a piston and cylinder within an internal combustion engine is nearly impossible to achieve. Therefore, some unburned air/fuel mixture and combustion byproducts escape past the sealing rings between the piston and cylinder during the compression and power strokes of the engine. These gases are generally known as crankcase vapors or "blow-by" gases, and mainly comprise hydrocarbons. These blow-by gases, once entering the crankcase, can degrade the quality of the engine oil and can otherwise damage the internal working parts of the engine. Additionally, the blow-by gases can increase the crankcase pressure which may reduce the life of the engines seals or gaskets resulting in oil leakage. Also, if such gases are allowed to escape from the engine, the hydrocarbons constitute additional emission pollutants. In order to overcome these problems, most modern engines include a positive crankcase ventilation (PVC) system which prevents the blow-by gases from escaping from the engine's crankcase into the atmosphere and may also allow fresh air to enter the crankcase and mix with the blow-by gases. The PCV system removes undesirable vapors from the crankcase by venting them directly into the intake manifold of the air intake system, and then into the combustion chamber where these vapors are burned with the air/fuel mixture.

As shown in FIG. 5, an engine 100 in a conventional manner is equipped with an air filter 102 which allows air to flow into a standard fuel/air mixing device or carburetor 104. The proper fuel/air mixture is achieved in carburetor 104. An inlet passage or throat 106 with a valve 107 provide an air passage into the intake manifold of the engine where the fuel/air mixture is made available to the combustion chamber for combustion.

As shown in the cutaway portion of FIG. 5, certain internal parts of the engine are illustrated. One of a series of cylinders 110 is shown, each cylinder having an exhaust valve 112 and a valve stem 114 connected at its upper end to one side of a rocker arm 116, and the other side of which is connected to push rod 118. These parts, under the control of the engine cam shaft (not shown) operate to open exhaust valve 112 at the appropriate point in the engine operating cycle. The valves and the operating assemblies for the bank of cylinders on the side of the engine where the cutaway portion is found are covered by a valve cover/rocker arm cover 120.

As discussed above, the exhaust gases which may accumulate in valve cover 120 are communicated back to the air intake system for further combustion by use of a positive crankcase ventilation system. As shown, this system includes hoses or other conduits connecting the valve chambers to the air intake via one-way valves. In this case, a PCV valve 124 is mounted on the valve cover and simply functions as a check valve allowing a flow of exhaust gases away from the valve cover 120. A first portion of PCV connecting line 34 communicates with the inlet of T-connector 32, and then the other portion of PCV line 34 interconnects the outlet of the T-connector 32 with the air intake system. As shown, a primary vacuum inlet 108 may be formed in communication with the air intake system which serves to draw the exhaust gases from within the valve cover 120 into the throat 106 of carburetor 104.

Figure 6:
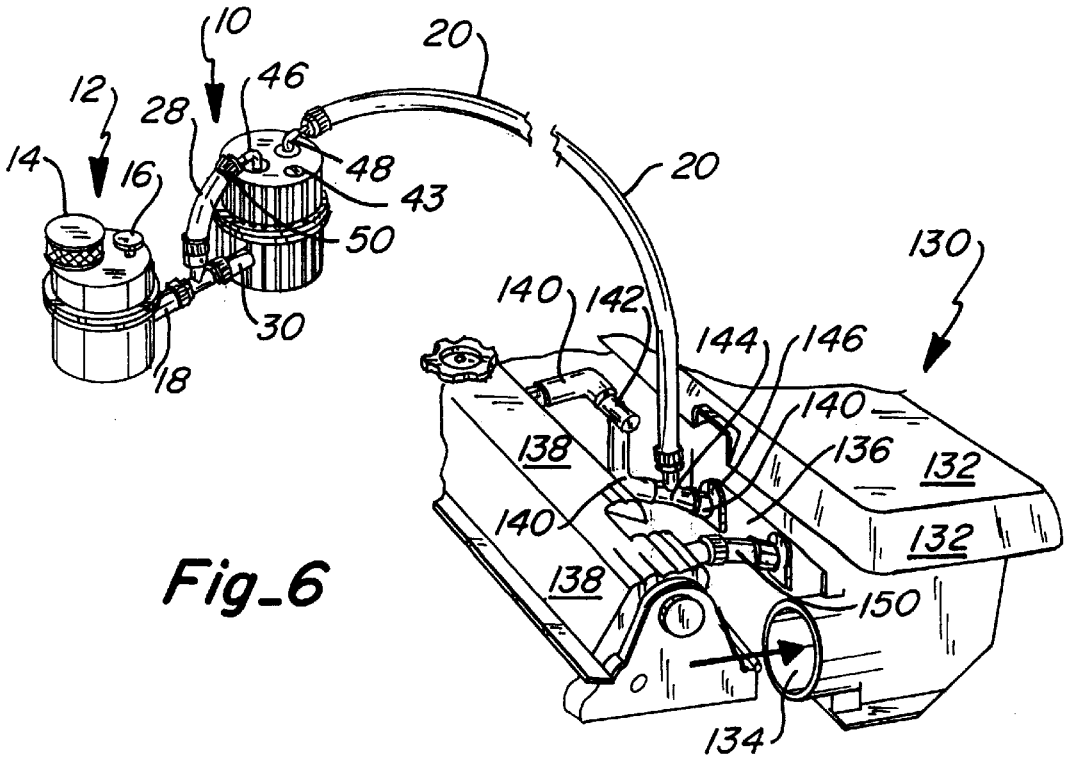
FIG. 6 shows the apparatus of this invention connected to a conventional internal combustion engine of the type found in more modern engines which may utilize computer-controlled fuel injection.

As shown in FIG. 6, the apparatus of this invention is installed in the same manner for newer engines which may utilize fuel injection as opposed to a carburetor. As shown, new engine 130 includes an air cleaner/filter 132 which is mounted to the side of a valve cover/rocker arm cover 138. An air inlet 134 (inlet hoses not shown) allows a flow of air into the engine. An intake manifold 136 communicates with the air flowing through the filter 132. A PCV line 140 allows exhaust gases accumulating within valve cover 138 to be reintroduced back into the intake manifold 136. As shown, the PCV valve 142 in this particular engine is not mounted to the valve cover, but rather is placed in line with PCV line 140. A T-connector 144 interposes PCV line 140 which allows a dual entry point for both valve cover exhaust gases and the air/additive mixture from container 10 to enter the intake manifold 136. As shown, an inlet port 146 is formed on intake manifold 136 in order to accommodate the connection of the PCV line 140. As with the engine shown in FIG. 5, the air intake system provides a vacuum pathway for drawing air flow from the PCV line 140 and transfer line 20 into the air intake manifold. As also shown in FIG. 6, a crankcase vent line 150 is found on some engines which allows some exhaust gases to be vented into the air cleaner. However, the apparatus of this invention achieves best performance when the air/additive mixture is introduced into the combustion chamber without having to flow through the air filter of the engine. Therefore, line 20 is preferably not interposed with line 150.

Because of the lightweight and relatively small size of the air regulator and additive container, they may be easily mounted under the hood of a vehicle directly adjacent the engine. Mounting brackets may be fashioned to allow the air regulator and additive container to be placed within any available open spaces adjacent the engine. Although the figures specifically illustrate the air regulator and additive container being side by side, it may be necessary to remote the air regulator for easy access which therefore requires a longer length transfer line 18.

In tests conducted with common passenger vehicles, it has been found that the additive container only needs to be refilled at 5,000-mile intervals when the additive container has an interior chamber size of approximately 100 cubic inches. The interior chamber used in such tests had dimensions of 3 inches (diameter of interior chamber) by 3.5 inches (height of interior chamber). However, it will be understood by those skilled in the art that the actual size of the interior chamber may be increased or decreased to provide a greater or lesser amount of time between refills.

As best understood at the time of this invention, there are a few known factors which will dictate the rate by which the additive is vaporized/atomized. One factor is the surface area which is exposed to the air flow. The greater the surface area exposed, the greater the vaporization/atomization rate. Another known factor is the type of additive used. For lower temperature melting point paraffin, it is assumed that this type of paraffin will more quickly liquefy because of its lower melting point. Therefore, this type of paraffin is more available for vaporization/atomization during engine operation. However, if paraffin having a higher melting point is used, then the external heat of the engine may not liquefy the entire amount of paraffin, or may not liquefy the paraffin as quickly, which means that less vaporization/atomization will occur during that period of engine operation. If the vehicle only travels a short distance, then the heat of the engine may liquefy little additive. Therefore, there may be minimal additive introduced into the engine. However, for situations in which an engine is operated over longer durations, the heat of the engine will liquefy the additive and, therefore, allow more of it to be vaporized/atomized for transfer to the engine. Another factor is the rate by which air flow contacts the exposed additive. If a higher rate of air flow is able to contact a given exposed area of additive, then this should result in a higher rate of vaporization/atomization as compared to exposure of the same given area of additive to a lower rate of air flow. If the liner 60 is used, then this will reduce the area of additive exposed as compared to use of the container without the liner. In addition to these factors discussed above, there may be other factors which affect the rate by which vaporization/atomization occurs.

For engine operations in colder temperatures, such as winter, it is desirable to use a paraffin having a lower melting point, such as 100° F. paraffin. During testing in colder temperatures, it has been found that a mix of 80% by volume paraffin and 20% by volume mothballs provides good fuel savings. As discussed above, the liner 60 is typically not used in colder temperatures.

In warmer operating temperatures such as during summer months, the liner 60 may be used along with paraffin having a higher melting point, such as 200° F. paraffin. A combination of 90% by volume paraffin and 10% by volume mothballs has been found to promote good fuel savings in vehicles tested during the warmer conditions.

Additionally, it has been found through testing that a 60% by volume paraffin and 40% by volume mothball combination provides good gas savings if a liner is not used in most all operating conditions.

Once the apparatus of this invention is installed within the desired vehicle, the air regulator must be set so that an acceptable amount of air flows through the container and into the PCV line. One way in which to determine proper air flow is to observe the performance of the engine when monitored by a gas analyzer such as found at state emission testing locations. For example, in the state of Colorado, regulations require the monitoring of exhaust contaminants such as hydrocarbons, carbon monoxide, and nitrous oxide. The apparatus of this invention was installed on a 1994 Chevrolet Blazer, 4.3 liter, V-6, sequential ported fuel injection engine. Assuming that the engine has been properly maintained and is functioning according to the manufacturer's specifications, it has been found that the air regulator is properly set for this type of vehicle when adjusted so that the emission readings from the gas analyzer are no more than half of the upper limits. As of 1998 in the state of Colorado, the upper limits for hydrocarbons, carbon dioxide, and nitrous oxide are 6, 53 and 9 grams per million, respectively. Accordingly, an acceptable set point for installation of the apparatus of this invention in the 1994 Blazer would occur by adjusting the air regulator so that emission readings were no more than 3, 26.5, and 4.5 grams per million for hydrocarbon, carbon dioxide, and nitrous oxide. In setting the air flow, a lean misfire of the engine indicates an improper air flow setting. Lean misfires usually result in the vehicle stalling, and/or emission readings which greatly exceed the upper limits. For the container size described above, it has been found through testing that an optimal flow rate of air through the container to achieve good engine performance for the 4.3 liter V-6 engine is 0.93 cubic feet per minute (cfm). It was also found that an air regulator utilizing a 1/16 inch orifice in conjunction with a means to adjust the flow through the orifice provides the necessary flow rate of air based upon the vacuum available from the air intake system.

Depending upon the type of vehicle, however, it shall be clearly understood that the regulated air flow may be freely adjusted to obtain optimum performance. It may also be desirable to use an air regulator which includes an integral flow meter to observe the flow rate of air into the container. Monitoring the flow rate of air is also a means by which one may judge the proper setting of the apparatus. Air flow data could be developed for different types of engines which could serve as a baseline for determining proper setup. Then, as necessary, the air flow regulator could be further adjusted based upon the observed performance of the engine when monitored by a gas analyzer, and based upon the gas mileage achieved during operation.

The following examples illustrate the enhanced performance of vehicles with the apparatus of this invention installed and using paraffin as the additive. Additionally, each of the vehicles were equipped with sparkplugs made and sold by Sonic Spark of Lakewood, Colo. The particular type of sparkplugs used are known commercially as the "Super Sonic Spark Plugs" of Sonic Spark.

EXAMPLE NO. 1

This example illustrates performance of an engine under conditions of a steady speed and load. Substantially all expressway driving was conducted.

A 1982 Vauxhall Cavalier was used having a carburetor and 6 cylinder engine with 109,010 miles on the odometer at the beginning of the test drive. The test was conducted at expressway speeds in the Manchester, England, United Kingdom area. Prior to the installation of the apparatus of this invention, baseline fuel economy of this vehicle was verified. The test results were as follows:

TABLE 1

| MPG Before Test | Fuel Type | Miles Driven During Test | Average Speed (MPH) | Fuel Consumption (Gallons) | MPG Achieved |
|---|---|---|---|---|---|
| 22 | Medium Grade Unleaded | 123 | 70 | 2.09 | 58.8 |

EXAMPLE 2

This test evaluated performance under conditions of steady speed and load on the engine. Substantially all expressway driving was conducted.

A 1989 Plymouth Voyager was used with a 2.2 liter, 4 cylinder, turbo charged fuel injected engine with 222,417 miles on the odometer at the beginning of the test. The test was conducted at expressway speeds in the Denver, Colo., U.S.A. area. Prior to the installation of the apparatus, baseline fuel economy of this vehicle was verified. The test results were as follows:

TABLE 2

| MPG Before Test | Fuel Type | Miles Driven During Test | Average Speed (MPH) | Fuel Consumption (Gallons) | MPG Achieved |
|---|---|---|---|---|---|
| 18.6 | Regular Unleaded | 142 | 65 | 3.27 | 43.4 |

EXAMPLE 3

This test evaluated performance under conditions of mixed city and highway driving. Approximately 30 miles were driven within a city at speeds between 30 mph and 50 mph, and 112 miles were driven on a highway at a steady speed of 70 mph. This test was also conducted under a fixed load condition.

A 1997 Renault/Megane was used with a 2 liter, 4 cylinder, fuel injected engine with 145,806 miles on the odometer at the beginning of the test. The test was conducted in the Manchester, England, United Kingdom area. Prior to the installation of the apparatus, the baseline economy of the vehicle was verified. The test results were as follows:

TABLE 3

| MPG Before Test | Fuel Type | Miles Driven During Test | Average Speed (MPH) | Fuel Consumption (Gallons) | MPG Achieved |
|---|---|---|---|---|---|
| 22 | Regular Unleaded | 107 | City: 30–50 Highway: 70 | 2.45 | 43.7 |

EXAMPLE 4

This test evaluated the performance in mountainous terrain on a highway, and under fixed load conditions.

A 1994 Chevrolet 4×4 Blazer was used with a 4.3 liter, V-6, fuel-injected engine, with 41,854 miles on the odometer at the beginning of the test. The test was conducted in the mountains surrounding the Denver, Colo., U.S.A. area. Prior to the installation of the apparatus, the baseline fuel economy of the vehicle was verified. The test results were as follows:

TABLE 4

| MPG Before Test | Fuel Type | Miles Driven During Test | Average Speed (MPH) | Fuel Consumption (Gallons) | MPG Achieved |
|---|---|---|---|---|---|
| 18.3 | Regular Unleaded | 141 | 60 | 2.32 | 60.7 |

As shown in the above examples, substantial fuel savings were achieved. Furthermore, substantial fuel savings were realized not only in highway driving, but in city driving and mountainous conditions which place additional stress on the engine. It should be understood that the above examples are merely representative of the type of results which may be achieved, and other vehicles under other driving conditions may have different results.

By the foregoing, it can be seen that a simple yet effective apparatus and method are provided to enhance the performance of an internal combustion engine. Using mothballs and/or paraffin as an additive enhances the combustion process as well as providing lubrication to the internal working parts of the engine. Because more complete combustion occurs, certain exhaust emissions such as hydrocarbons are reduced as well. The apparatus is easily installed and requires little setup. Paraffin and mothballs are relatively safe products, and can be handled without special permits or exposing a user to unnecessary hazards. No external heating or cooling devices are required to operate the apparatus. The refill of the container housing the additive is easily accomplished through a refill/access cover. If it is desired to disconnect the apparatus from the engine, the air regulator can simply be closed so that no air is allowed to flow through the container. Paraffin or mothballs as additives are inexpensive and easily accessible.

This invention has been described in detail with reference to particular embodiments thereof, but it will be understood that various other modifications can be effected within the spirit and scope of this invention.

What is claimed is:

1. An apparatus for supplying an additive to an internal combustion engine of the type having an engine air filter which allows filtered air to enter an air intake system of the engine, said apparatus comprising:

a container mounted externally to said engine and having a quantity of additive therein, said additive being selected from the group consisting of paraffin or mothballs, said container having a first inlet, an outlet, and an open area within said container communicating with said first inlet and said outlet;

an air flow regulator connected to said first inlet and remote from the engine air filter of the engine for regulating a desired flow of air through said container; and a liner placed within said container for holding the quantity of additive said liner spaced from said container allowing the flow of air to contact the liner;

means for connecting said outlet of said container to the air intake system of the internal combustion engine, wherein said additive is mixed with said flow of air as it first passes through said regulator and then passes through said container to create a mixture, and said mixture is introduced into a combustion chamber of the engine through the air intake system for combustion within the combustion chamber of the engine.

2. An apparatus, as claimed in claim 1, wherein:

said additive is paraffin and mothballs.

3. An apparatus, as claimed in claim 1, wherein said air flow regulator further includes:

an air filter for filtering air entering said air flow regulator.

4. An apparatus, as claimed in claim 1, wherein said container further includes:

a second inlet communicating with said air flow regulator allowing air flow into said container at an additional location.

5. An apparatus, as claimed in claim 1, wherein said container further includes:

an access cover for refill of said additive.

6. An apparatus, as claimed in claim 1, wherein said container further includes:

a plurality of heat transfer ribs formed thereon to assist in heat transfer to said container from the internal combustion engine.

7. An apparatus for supplying an additive to an internal combustion engine of the type having an engine air filter which allows filtered air to enter an air intake system of the engine, said apparatus comprising:

a container having a quantity of additive therein, said container being mounted externally to said internal combustion engine;

means for supplying a desired flow of air through said container mounted adjacent said container and remote from the engine air filter of the engine, the flow of air first flowing through said means for supplying and then flowing through said container, wherein the air and the additive are mixed to create a mixture;

a liner placed within said container for holding the quantity of additive, said liner spaced from said container allowing the flow of air to contact the liner;

means for supplying said mixture from the container to the air intake system of the internal combustion engine, wherein said mixture is then introduced into a combustion chamber of the engine for combustion; and wherein said additive is selected from the group consisting of paraffin or mothballs.

8. An apparatus, as claimed in claim 7, wherein:

said additive is paraffin and mothballs.

9. An apparatus, as claimed in claim 7, wherein said means for supplying a desired flow of air further includes:

an air filter for filtering air entering said means for supplying.

10. An apparatus, as claimed in claim 7, wherein said container further includes:

a second inlet communicating with said means for supplying a desired flow of air allowing air into said container at an additional location.

11. An apparatus, as claimed in claim 7, wherein said container further includes:

an access cover for refill of said additive.

12. An apparatus, as claimed in claim 7, wherein said container further includes:

a plurality of heat transfer ribs formed thereon to assist in heat transfer to said container from the internal combustion engine.

13. A method of supplying an additive to an internal combustion engine wherein a flow of air flows from an upstream location to a downstream location to deliver the additive to the engine, said method comprising the steps of:

mounting an air flow regulator and a container having a quantity of additive therein to the internal combustion engine;

placing the air flow regulator upstream of the container wherein the flow of air first flows through the air flow regulator and then to the container;

providing a liner within the container to hold the additive;

directing the flow of air controlled by said air flow regulator through said container and contacting the liner to create a mixture of additive and air;

supplying the mixture to an air intake system of the internal combustion engine; and wherein said additive is selected from the group consisting of paraffin or mothballs.

14. A method, as claimed in claim 13, further comprising the step of:

directing the flow of air controlled by said air flow regulator at two points through said container to create the mixture.

15. A method, as claimed in claim 13, further comprising the steps of:

monitoring the air flow rate through the container to determine acceptable setup.

16. A method, as claimed in claim 13, further comprising the step of:

monitoring an engine analyzer connected to the internal combustion engine to determine acceptable setup.

17. A method, as claimed in claim 13, further comprising the step of:

adjusting the amount of air flow through the container to vary the mixture of the additive and air supplied to the air intake system.

* * * * *